US010906062B2

(12) United States Patent
Zeller

(10) Patent No.: US 10,906,062 B2
(45) Date of Patent: Feb. 2, 2021

(54) QUICK RELEASE PAINT ROLLER SYSTEM

(71) Applicant: John E. Zeller, N. Las Vegas, NV (US)

(72) Inventor: John E. Zeller, N. Las Vegas, NV (US)

( * ) Notice: Subject to any disclaimer, the term of this patent is extended or adjusted under 35 U.S.C. 154(b) by 0 days.

(21) Appl. No.: 16/425,766

(22) Filed: May 29, 2019

(65) Prior Publication Data

US 2020/0376517 A1 Dec. 3, 2020

(51) Int. Cl.
*B05C 17/02* (2006.01)

(52) U.S. Cl.
CPC ..... *B05C 17/0217* (2013.01)

(58) Field of Classification Search
CPC ... B05C 17/02; B05C 17/0217; B05C 17/021; B05C 17/0225
USPC ..... 15/230.11; 492/13, 19
See application file for complete search history.

(56) References Cited

U.S. PATENT DOCUMENTS 5,921,905 A * 7/1999 Newman, Jr. ..... B05C 17/0217 492/13
7,827,651 B2 11/2010 Graham et al.
2009/0064436 A1* 3/2009 Scott, Sr. ..... B05C 17/0217 15/230.11
2009/0133207 A1* 5/2009 Dale ..... B05C 17/0217 15/230.11
2014/0304934 A1* 10/2014 Troudt ..... B44D 3/14 15/230.11

FOREIGN PATENT DOCUMENTS

DE 19531385 * 2/1997

* cited by examiner

*Primary Examiner* — Mark Spisich
(74) *Attorney, Agent, or Firm* — Runyan Law; Charles Runyan

(57) ABSTRACT

A quick release paint roller system; the quick release paint roller system includes a paint roller assembly including a paint roller frame having a first-bracket-arm having a first-retaining-pin, a second-bracket-arm having a second-retaining-pin, a handle, a first-endcap, a second-endcap, a locking mechanism, and a user-control including a finger actuated release button. The paint roller frame allows a hosted paint roller to be removed in a hands-free manner without direct, manual contact with the paint roller, thus eliminating mess, waste, and inconvenience that would ordinarily result with standard manual brush removal.

20 Claims, 5 Drawing Sheets

QUICK RELEASE PAINT ROLLER SYSTEM

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of painting devices and more specifically relates to paint roller frames configured to host a paint roller.

2. Description of Related Art

Typically, paint is applied to a wall or other surface using paint roller assemblies having a handle with a roller support and a rotatable roller. Conventionally, the roller is removably mounted on the roller support so that the roller can be detached from the support after use and cleaned or replaced as desired. The roller is usually removed from the handle after each use. One disadvantage associated with this type of roller support is that in order to remove the roller from the roller support, it is usually necessary to grasp the outer surface of the roller and slide it off of the roller support. The process of removing a used roller from the roller assembly can be messy and often leads to paint getting on the hands and clothes of the person removing the roller. A suitable solution is desired.

U.S. Pat. No. 7,827,651 to Nicholas Simon Graham, et al. relates to a quick release paint roller. The described quick release paint roller has a roller cover that can be removed from a handle assembly without requiring the user to apply a force directly to the roller cover. The paint roller includes a tube-shaped roller cover having an outer surface of paint absorbing material and a rotatably mounted roller core. When the actuator is in the release position, the roller mounting device is free of the latching mechanism, thus permitting the roller core and roller cover to be removed from the handle assembly.

BRIEF SUMMARY OF THE INVENTION

In view of the foregoing disadvantages inherent in the known painting devices art, the present disclosure provides a novel quick release paint roller system. The general purpose of the present disclosure, which will be described subsequently in greater detail, is to provide a paint roller frame that allows a hosted paint roller to be removed without direct, manual contact with the paint roller, thus eliminating mess, waste, and inconvenience that would ordinarily result with standard manual removal.

A quick release paint roller system is disclosed herein. The quick release paint roller system includes a paint roller handle that provides stable support to hosted paint rollers during use and allows for hands-free release of the paint rollers as desired. The quick release paint roller system in preferred embodiments comprises a paint roller assembly including a paint roller frame having a first-bracket-arm having a first-retaining-pin, a second-bracket-arm having a second-retaining-pin, a handle, a first-endcap, a second-endcap, a locking mechanism, and a user-control including a finger actuated release button.

The handle of the paint roller frame comprises a top-end and a bottom-end. The top-end of the handle hosts the first-bracket-arm and the second-bracket-arm. The first-bracket-arm and the second-bracket-arm are configured to move between an engaged position and a releasing position. The first-endcap and the second-endcap are removably mounted to opposing open ends of a paint roller. The first-endcap is configured to engage with the first-retaining-pin of the first-bracket-arm and the second-endcap is configured to engage the second-retaining-pin of the second-bracket-arm such that the paint roller is supported between the first-bracket-arm and the second-bracket-arm. Manipulation of the user-control is configured to actuate movement between the engaged position to mount the paint roller between the first-bracket-arm and the second-bracket-arm and the releasing position to release the paint roller. The locking mechanism is configured to lock the first-bracket-arm and the second-bracket-arm in the engaged position via user manipulation of the locking mechanism.

A user may apply the first-endcap and the second-endcap within the opposing open ends of a paint roller. They may then release the locking mechanism of the device to free the first-bracket-arm and the second-bracket-arm. Next the user may depress the finger actuated release button which will extend the first-bracket-arm and the second-bracket-arm to allow for receipt of the paint roller. After the paint roller is applied upon the first-retaining-pin and the second-retaining-pin of the respective bracket arms, the locking mechanism will then be re-engaged. The user may then paint solid surfaces with the device. When in need to remove the paint roller, the user may position the paint roller assembly over a receptacle, and then release the locking mechanism and depress the finger actuated release button. This will cause the first-bracket-arm and the second-bracket-arm to extend away from each other, which will release the paint roller, allowing it to drop away from the device.

The quick release paint roller system may be provided as a kit including a paint roller frame, a first-endcap, a second-endcap, and a set of instructions. The first-endcap and the second-endcap are preferably replaceable and may be included or provided separately.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a quick release paint roller system, constructed and operative according to the teachings of the present disclosure.

The various embodiments of the present invention will hereinafter be described in conjunction with the appended drawings, wherein like designations denote like elements.

DETAILED DESCRIPTION

Figure 1:
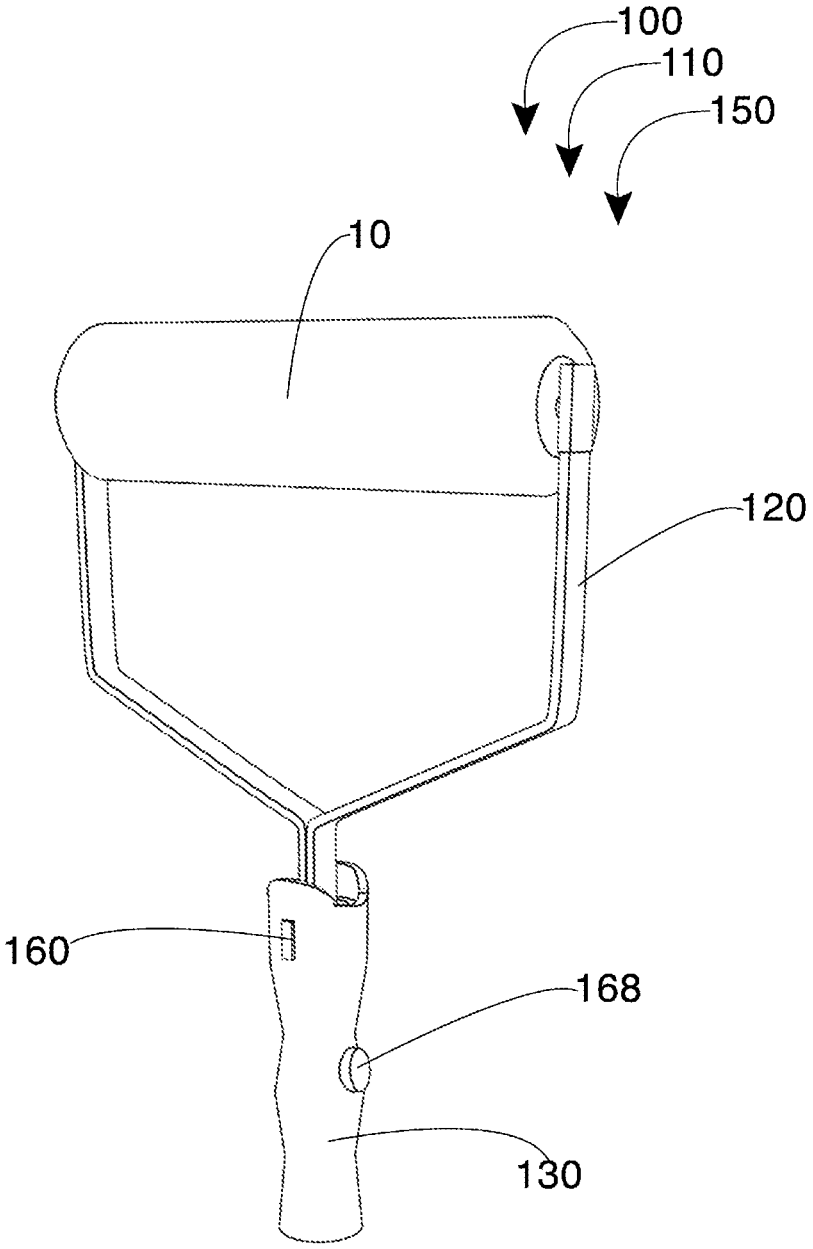
FIG. 1 is a perspective view of the quick release paint roller system, according to an embodiment of the disclosure.

As discussed above, embodiments of the present disclosure relate to a painting device and more particularly to a quick release paint roller system as used to improve the use of paint rollers and removal thereof. The quick release paint roller system eliminates mess and damage when removing a paint roller from a paint roller frame after use.

Generally, a paint roller frame is provided that allows a hosted paint roller to be removed without direct, manual contact with the paint roller, thus eliminating mess, waste, and inconvenience that would ordinarily result with standard manual brush removal. The quick release paint roller system includes a paint roller frame having two bracket arms that securely host a paint roller, and the arms feature retaining pins to facilitate support of the paint roller. Additionally, the design of the bracket arms allows each bracket arm to act as border along various edges. Within a handle of the paint roller frame the two bracket arms terminate, and are in communication with a rubber retention band, two durable springs, a pivot point, and a push button that is accessed from an exterior of the handle. The push button, when depressed, separates the bracket arms to allow hands-free release of a paint roller or replacement of the paint roller. The invention further comprises a locking mechanism that secures the two bracket arms in an engaged position to prevent accidental release of a paint roller during use. The quick release paint roller system may include a splash guard attachable to the structure at various points of convenient applicability.

In a preferred embodiment, the bracket arms of the device are made of aluminum alloy. Their outer endpoints each have an approximate four-inch (4") length, then extend at a slight horizontal angle for a linear extension of approximately four and one-half inches (4½"), then return to alignment. In extension from that point of alignment, the inner endpoint of a first bracket arm extends for approximately five inches (5") in length. The inner endpoint of a second bracket arm extends for approximately two and one-half inches (2½"), then extends outward at an approximate ninety-degree angle for approximately one inch (1") in length. These endpoints are contained within a handle, made of cellulose acetate in columnar format with an approximate six-inch length by one-inch diameter (6"×1"). The angled extension of the aforementioned second bracket arm projects through an aperture within this handle and ends in an extended button.

The bracket arms are positioned to allow the width between their exterior endpoints to be approximately nine inches (9") to accommodate hosting of a standard roller brush. Extending inward from each of these endpoints are retaining pins with approximate three-quarter inch (¾") lengths. Attachable to these retaining pins are free-rotating, brush-hosting endcaps made of polyvinyl chloride (PVC). At the top contact point of the bracket arms, and within the handle, is an elasticized band that holds them in place while allowing their controlled motion. Below the elasticized band and featured between the interior sidewalls of the handle and each individual bracket arm, are tension springs. Directly below these tension springs and positioned between the two (2 ) bracket arms, is a pivot point structure. Directly at its top point where the bracket arms are first contained within its structure, is a locking mechanism, which immobilizes both bracket arms simultaneously. Extending through the handle is a lever operable by finger that allows operation of the locking mechanism. The exterior endpoint of the handle features an interior, threaded column of two-inch (2") depth for receiving handle extensions. In another embodiment, the quick release paint roller system includes a single bracket arm which hosts a spindle of extendable diameter or in which the spindle would include extendable/retractable appendages, and in which a button or other exterior control device would control this diameter extension and/or appendage motion, allowing the roller brush to drop from the spindle upon operation of the button.

Referring now more specifically to the drawings by numerals of reference, there is shown in FIGS. 1-5, various views of a quick release paint roller system 100. FIG. 1 shows a quick release paint roller system 100 during an 'in-use' condition 150, according to an embodiment of the present disclosure. As illustrated, the quick release paint roller system 100 may comprise a paint roller assembly 110 including a paint roller frame 120 having a first-bracket-arm 122 having a first-retaining-pin 124, a second-bracket-arm 126 having a second-retaining-pin 128, a handle 130, a first-endcap 140, a second-endcap 142, a locking mechanism 160, and a user-control 168 in functional combination.

The handle 130 of the paint roller frame comprises a top-end 132 and a bottom-end 134; the first-bracket-arm 122 and the second-bracket-arm 126 extend from the top-end 132 of the handle 130. The first-bracket-arm 122 and the second-bracket-arm 126 are configured to move between an engaged position and a releasing position. The first-endcap 140 and the second-endcap 142 may be removably mounted to opposing open ends of a paint roller 10. The first-endcap 140 is configured to engage with the first-retaining-pin 124 of the first-bracket-arm 122 and the second-endcap 142 is configured to engage the second-retaining-pin 128 of the second-bracket-arm 126 such that the paint roller 10 is supported between the first-bracket-arm 122 and the second-bracket-arm 126. Manipulation of the user-control 168 is configured to actuate movement between the above-mentioned engaged position in order to mount the paint roller 10 between the first-bracket-arm 122 and the second-bracket-arm 126 and the releasing position to release the paint roller 10. The locking mechanism 160 is configured to lock the first-bracket-arm 122 and the second-bracket-arm 126 in the engaged position via user manipulation of the locking mechanism 160.

Figure 2:
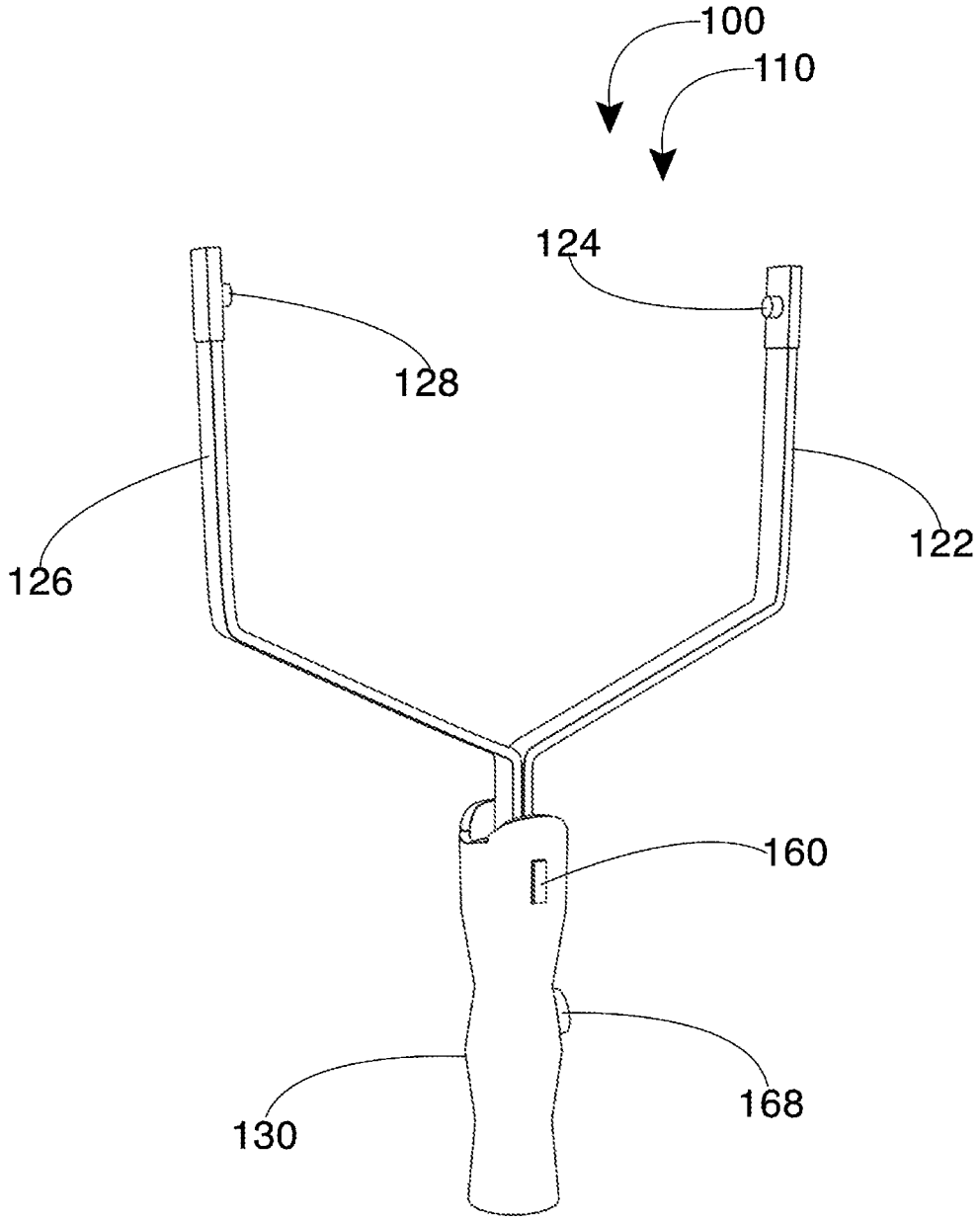
FIG. 2 is a front view of the quick release paint roller system of FIG. 1, according to an embodiment of the present disclosure.

FIG. 2 shows a perspective view of the quick release paint roller system 100 of FIG. 1, according to an embodiment of the present disclosure. As above, the quick release paint roller system 100 may include the paint roller assembly 110 including the paint roller frame 120 comprising the first-bracket-arm 122, the second-bracket-arm 126, the handle 130, the locking mechanism 160, and the user-control 168. The user-control 168 of the paint roller assembly preferably includes a finger actuated release button (other means may be used). Depression of the finger actuated release button widens a gap between the first-bracket-arm 122 and the second-bracket-arm 126 for the releasing position such that a supported paint roller 10 may independently drop away. The locking mechanism 160 includes a switch positioned on the handle 130. The switch may be toggled between a locked and unlocked position. As further shown in FIG. 4A and 4B, the locking mechanism 160 includes a wedge member 162 which contacts the first-bracket-arm 122 during a locked condition. The system may use various locking mechanisms 160 and implements that allow the first-bracket-arm 122 and the second-bracket-arm 126 to be separated from each other in order to release a paint roller 10.

The first-bracket-arm 122 and the second-bracket-arm 126 extend outwardly perpendicularly from a handle-aperture 136 positioned at the top-end 132 of the handle 130 forming a Y-shaped paint roller frame 120. The handle-aperture 136 being sized to accommodate movement of the first-bracket-arm 122 and the second-bracket-arm 126 between the engaged position and the releasing position. The paint roller assembly 110 distributes paint evenly by ensuring even pressure upon both ends of the paint roller 10.

Figure 3:
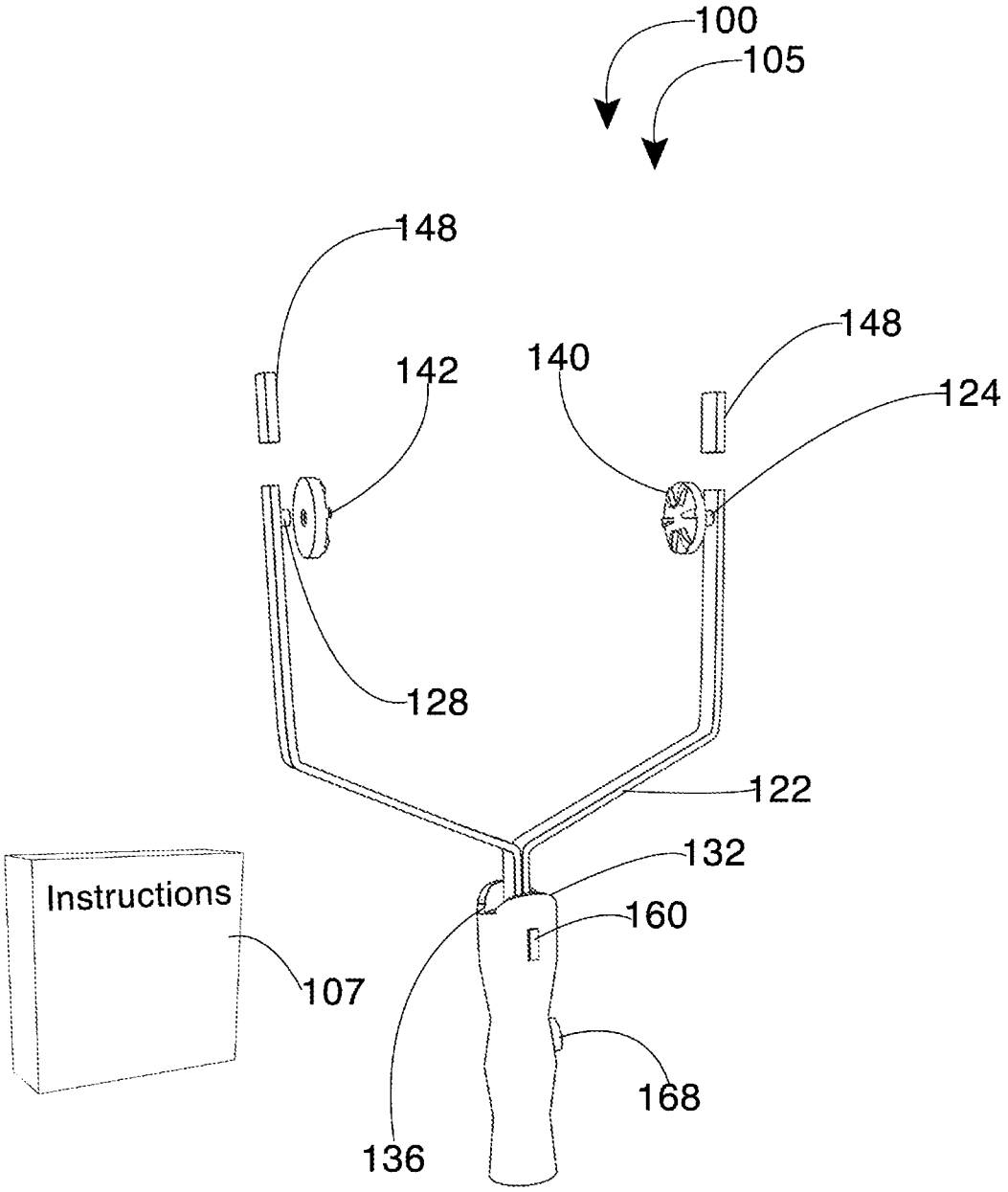
FIG. 3 is a view of the quick release paint roller system of FIG. 1 including a kit, according to an embodiment of the present disclosure.

According to one embodiment, the quick release paint roller system 100 may be arranged as a kit 105, shown in FIG. 3. In particular, the quick release paint roller system 100 may further include a set of instructions 107. The instructions 107 may detail functional relationships in relation to the structure of the quick release paint roller system 100 such that the quick release paint roller system 100 can be used, maintained, or the like, in a preferred manner.

As mentioned above, the first-endcap 140 is configured to engage with the first-retaining-pin 124 and the second-endcap 142 is configured to engage the second-retaining-pin 128. The first-endcap 140 and the second-endcap 142 comprise apertures for receiving the first-retaining-pin 124 and the second-retaining-pin 128 respectively. The paint roller 10 is able to rotate during an engaged state. The first-endcap 140 and the second-endcap 142 are configured to be friction fit within each of the opposing open ends of the paint roller 10. In certain embodiments, the first-endcap 140 and the second-endcap 142 are integral to the paint roller frame 120 or included with the paint roller assembly 110. In other embodiments, the first-endcap 140 and the second-endcap 142 are replaceable and provided separately.

The system may further include arm end caps 148 for slidably engaging and concealing top end-portions of the first-bracket-arm 122 and the second-bracket-arm 126. The arm end caps 148 form as even border as a user runs the paint roller assembly down a wall in a concealed space such as up against another wall. Further the arm end caps 148 prevent paint from spreading to another surface such as an abutting wall.

Figure 4A:
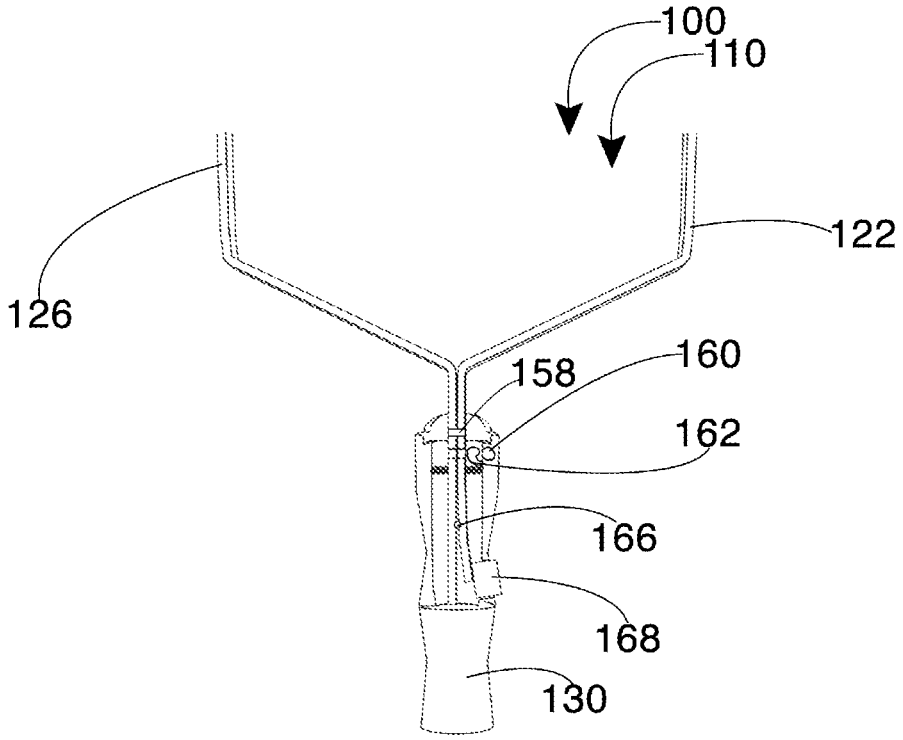
FIG. 4A is a cross-sectional view of the quick release paint roller system of FIG. 1, according to an embodiment of the present disclosure.
Figure 4B:
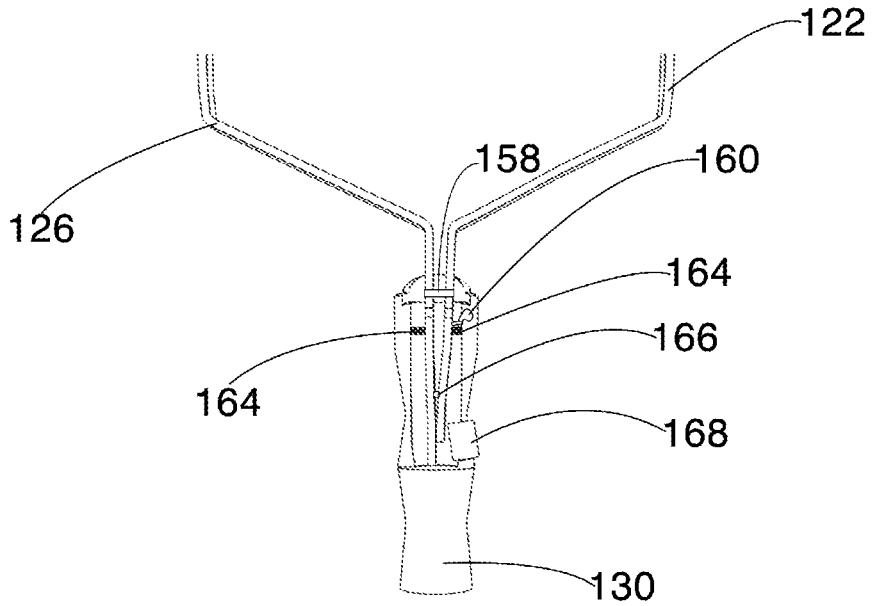
FIG. 4B is a cross-sectional view of the quick release paint roller system of FIG. 1, according to an embodiment of the present disclosure.

As shown in FIGS. 4A and 4B the quick release paint roller system 100 of FIG. 1 includes the paint roller frame 120 comprising the first-bracket-arm 122 having a first-retaining-pin 124, the second-bracket-arm 126 having a second-retaining-pin 128, the handle 130, the locking mechanism 160, and the user-control 168. The handle 130 houses two tension springs 164 and a pivot point member 166 positioned between the first-bracket-arm 122 and the second-bracket-arm 126. An elasticized band 158 may be included to bind the first-bracket-arm 122 and the second-bracket-arm 126 together at their initial point of contact. The two tension springs 164 are positioned on outer portions of the first-bracket-arm 122 and the second-bracket-arm 126 between an inner wall of the handle 130 and the outer portions of the first-bracket-arm 122 and the second-bracket-arm 126.

As shown in FIG. 4A, a terminal end of the first-bracket-arm 122 comprises a curved profile extending away from the second-bracket-arm 126. The first-bracket-arm 122 is in contact with an interior portion of the finger actuated release button within the handle 130. Compression of the finger actuated release button (user-control 168) actuates a pivoting movement of the first-bracket-arm 122 about the pivot point member 166. The pivot point member 166 comprises a columnar shaft; pivoting movement of the first-bracket-arm 122 about the pivot point member 166 causes the first-bracket-arm 122 and the second-bracket-arm 126 to separate and move between the engaged position to the releasing position.

Figure 5:
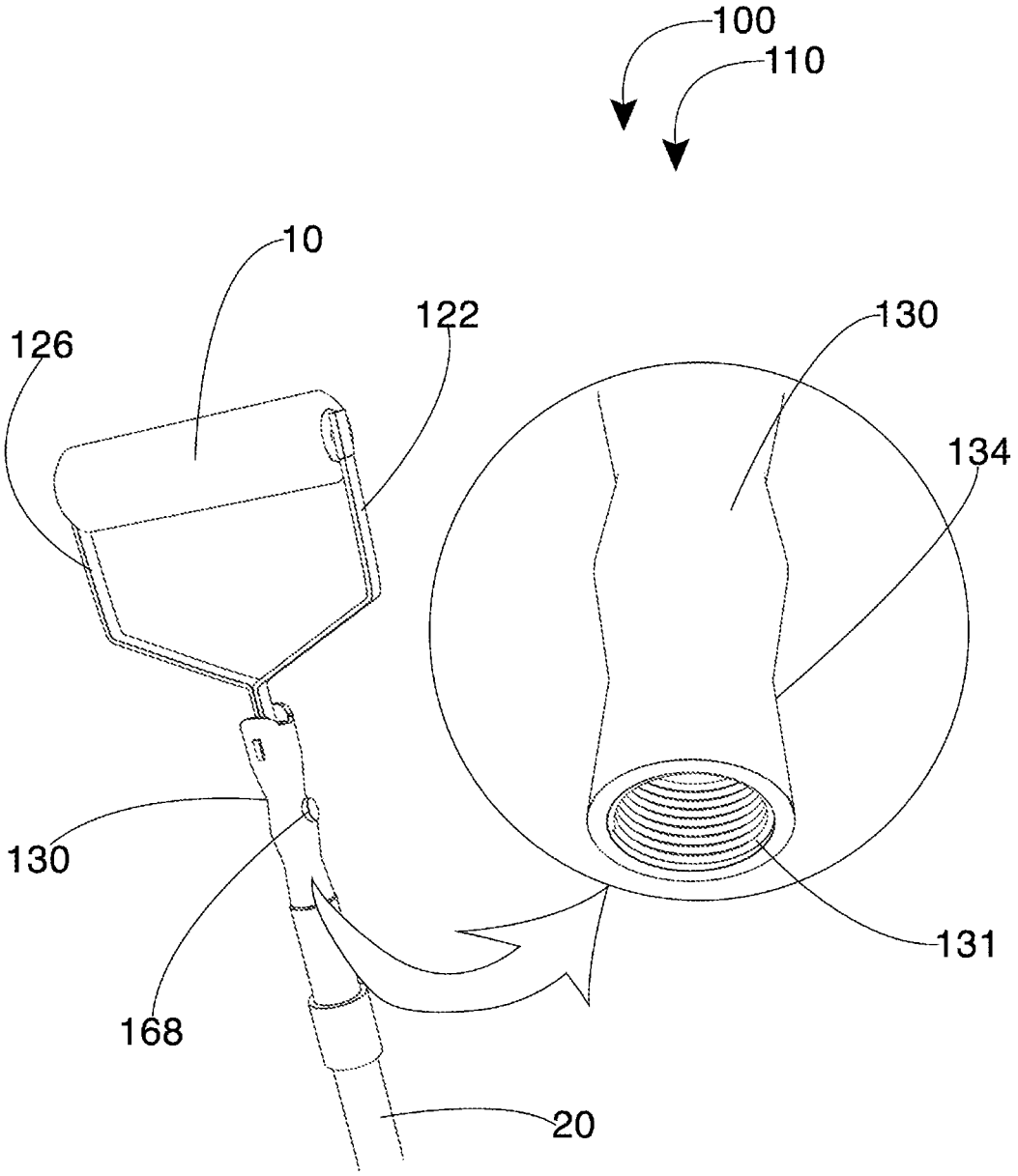
FIG. 5 is a perspective view of the quick release paint roller system of FIG. 1, according to an embodiment of the present disclosure.

The paint roller assembly 110 may be produced in various sizes and shapes to accommodate paint rollers 10 of various sizes and shapes, including but not limited to paint rollers 10 of standard nine-inch (9") length and smaller variations of a four-inch (4") length. The first-bracket-arm 122 and the second-bracket-arm 126 may comprise various materials of applicable durability, such as but not limited to aluminum alloy, stainless steel and high-density polyethylene (HDPE). The handle 130 of the device may comprise various materials of applicable durability, such as but not limited to cellulose acetate and polyvinyl chloride (PVC). The first-endcap 140 and second-endcap 142 may comprise aluminum alloy, polyvinyl chloride (PVC), or other suitable equivalent materials. As shown in FIG. 5, the bottom-end 134 of the handle 130 comprises a threaded aperture 131 configured to receive an extension pole 20.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appeneded claims:

1. A quick release paint roller system comprising:

a paint roller assembly including a paint roller frame having a first-bracket-arm;

a first-retaining-pin;

a second-bracket-arm;

a second-retaining-pin;

a handle;

a first-endcap;

a second-endcap;

a locking mechanism; and a user-control comprising a finger actuated release button;

wherein said handle comprises a top-end and a bottom-end, said top-end hosts said first-bracket-arm and said second-bracket-arm;

wherein said first-bracket-arm and said second-bracket-arm are configured to move between an engaged position and a releasing position;

wherein said first-endcap and said second-endcap are removably mounted to opposing open ends of a paint roller, said first-endcap is configured to engage with said first-retaining-pin of said first-bracket-arm, said second-endcap is configured to engage said second-retaining-pin of said second-bracket-arm such that said paint roller is supported between said first-bracket-arm and said second-bracket-arm;

wherein manipulation of said user-control is configured to actuate movement between said engaged position to mount said paint roller between said first-bracket-arm and said second-bracket-arm and said releasing position to release said paint roller; and wherein said locking mechanism is configured to lock said first-bracket-arm and said second-bracket-arm in said engaged position via user manipulation of said locking mechanism.

2. The quick release paint roller system of claim 1, wherein depression of said finger actuated release button separates said first-bracket-arm from said second-bracket-arm into said releasing position.

3. The quick release paint roller system of claim 2, wherein said first-endcap and said second-endcap comprise apertures for receiving said first-retaining-pin and said second-retaining-pin respectively, said paint roller being able to rotate during an engaged state.

4. The quick release paint roller system of claim 3, wherein said first-endcap and said second-endcap are friction fit within each of said opposing open ends of said paint roller.

5. The quick release paint roller system of claim 4, further comprising a locking mechanism control having a switch positioned on said handle.

6. The quick release paint roller system of claim 5, wherein said locking mechanism control includes a wedge member which contacts said first-bracket-arm during a locked condition.

7. The quick release paint roller system of claim 1, wherein said handle houses two tension springs and a pivot point member positioned between said first-bracket-arm and said second-bracket-arm.

8. The quick release paint roller system of claim 7, wherein a terminal end of said first-bracket-arm comprises a curved profile extending away from said second-bracket-arm, said first-bracket-arm is in contact with an interior portion of said finger actuated release button within said handle.

9. The quick release paint roller system of claim 8, wherein compression of said finger actuated release button actuates a pivoting movement of said first-bracket-arm about said pivot point member.

10. The quick release paint roller system of claim 9, wherein said pivot point member comprises a columnar shaft, pivoting movement of said first-bracket-arm about said pivot point member causes said first-bracket-arm and said second-bracket-arm to separate and move between said engaged position to said releasing position.

11. The quick release paint roller system of claim 7, wherein said two springs are positioned on outer portions of said first-bracket-arm and said second-bracket-arm between an inner wall of said handle and said outer portions of said first-bracket-arm and said second-bracket-arm.

12. The quick release paint roller system of claim 1, wherein said first-bracket-arm and said second-bracket-arm extend outwardly perpendicularly from a handle-aperture positioned at said top-end of said handle forming a Y-shaped said paint roller frame.

13. The quick release paint roller system of claim 12, wherein said handle-aperture being sized to accommodate movement of said first-bracket-arm and said second-bracket-arm between said engaged position and said releasing position.

14. The quick release paint roller system of claim 1, wherein said bottom-end of said handle comprises a threaded aperture configured to receive an extension pole.

15. The quick release paint roller system of claim 1, wherein said paint roller is a 9-inch long tubular said paint roller.

16. The quick release paint roller system of claim 1, further comprises arm end caps for slidably engaging and concealing end-portions of said first-bracket-arm and said second-bracket-arm.

17. A quick release paint roller system, the quick release paint roller system comprising:

a paint roller assembly including a paint roller frame having a first-bracket-arm;

a first-retaining-pin;

a second-bracket-arm;

a second-retaining-pin;

a handle;

a first-endcap;

a second-endcap;

a locking mechanism; and a user-control;

wherein said handle comprises a top-end and a bottom-end, said top-end hosts said first-bracket-arm and said second-bracket-arm;

wherein said first-bracket-arm and said second-bracket-arm are configured to move between an engaged position and a releasing position;

wherein said first-endcap and said second-endcap are removably mounted to opposing open ends of a paint roller, said first-endcap is configured to engage with said first-retaining-pin of said first-bracket-arm, said second-endcap is configured to engage said second-retaining-pin of said second-bracket-arm such that said paint roller is supported between said first-bracket-arm and said second-bracket-arm;

wherein manipulation of said user-control is configured to actuate movement between said engaged position to mount said paint roller between said first-bracket-arm and said second-bracket-arm and said releasing position to release said paint roller;

wherein said locking mechanism is configured to lock said first-bracket-arm and said second bracket-arm in said engaged position via user manipulation of said locking mechanism;

wherein said user-control comprises a finger actuated release button;

wherein depression of said finger actuated release button separates said first-bracket-arm from said second-bracket-arm into said releasing position;

wherein said first-endcap and said second-endcap comprise apertures for receiving said first-retaining-pin and said second-retaining-pin respectively, said paint roller being able to rotate during an engaged state;

wherein said first-endcap and said second-endcap are friction fit within each of said opposing open ends of said paint roller;

wherein said locking mechanism comprising a switch positioned on said handle;

wherein said locking mechanism includes a wedge member which contacts said first-bracket-arm during a locked condition;

wherein said handle houses two tension springs and a pivot point member positioned between said first-bracket-arm and said second-bracket-arm;

wherein a terminal end of said first-bracket-arm comprises a curved profile extending away from said second-bracket-arm, said first-bracket-arm is in contact with an interior portion of said finger actuated release button within said handle;

wherein compression of said finger actuated release button actuates a pivoting movement of said first-bracket-arm about said pivot point member;

wherein said pivot point member comprises a columnar shaft, pivoting movement of said first-bracket-arm about said pivot point member causes said first-bracket-arm and said second-bracket-arm to separate and move between said engaged position to said releasing position;

wherein said first-bracket-arm and said second-bracket-arm extend outwardly perpendicularly from a handle-aperture positioned at said top-end of said handle forming a Y-shaped said paint roller frame;

wherein said handle-aperture being sized to accommodate movement of said first-bracket-arm and said second-bracket-arm between said engaged position and said releasing position;

wherein said bottom-end of said handle comprises a threaded aperture configured to receive an extension pole;

wherein said two springs are positioned on outer portions of said first- bracket-arm and said second-bracket-arm between an inner wall of said handle and said outer portions of said first-bracket-arm and said second-bracket-arm;

wherein said paint roller is a 9-inch long tubular said paint roller; and wherein said quick release paint roller system further comprises arm end caps for slidably engaging and concealing end-portions of said first-bracket-arm and said second-bracket-arm.

18. A quick release paint roller system comprising:

a paint roller assembly including a paint roller frame having a first-bracket-arm;

a first-retaining-pin;

a second-bracket-arm;

a second-retaining-pin;

a handle;

a first-endcap;

a second-endcap;

a locking mechanism; and a user-control;

wherein said handle comprises a top-end and a bottom-end, said top-end hosts said first-bracket-arm and said second-bracket-arm, wherein said first-bracket-arm and said second-bracket-arm are configured to move between an engaged position and a releasing position, wherein said first-endcap and said second-endcap are removably mounted to opposing open ends of a paint roller, wherein manipulation of said user-control is configured to actuate movement between said engaged position to mount said paint roller between said first-bracket-arm and said second-bracket-arm and said releasing position to release said paint roller, wherein said locking mechanism is configured to lock said first-bracket-arm and said second-bracket-arm in said engaged position via user manipulation of said locking mechanism, wherein said first-endcap is configured to engage with said first-retaining-pin and said second-endcap is configured to engage said second-retaining-pin, wherein said first-endcap and said second-endcap comprise apertures for receiving said first-retaining-pin and said second-retaining-pin respectively, said paint roller being able to rotate during an engaged state, wherein said first-endcap and said second-endcap are friction fit within each of said opposing open ends of said paint roller, further comprising a locking mechanism control having a switch positioned on said handle, and wherein said locking mechanism control includes a wedge member which contacts said first-bracket-arm during a locked condition.

19. The quick release paint roller system of claim 18, wherein said handle houses two tension springs and a pivot point member positioned between said first-bracket-arm and said second-bracket-arm.

20. The quick release paint roller system of claim 19, wherein a terminal end of said first-bracket-arm comprises a curved profile extending away from said second-bracket-arm, said first-bracket-arm is in contact with an interior portion of a finger actuated release button of the user control within said handle.

* * * * *